US007642994B2

(12) United States Patent
Cho et al.

(10) Patent No.: US 7,642,994 B2
(45) Date of Patent: Jan. 5, 2010

(54) PLASMA DISPLAY

(75) Inventors: Jang Hwan Cho, Chilgok-gun (KR); Yun Kwon Jung, Gumi-si (KR); Ju Won Seo, Pohang-si (KR)

(73) Assignee: LG Electronics Inc., Seoul (KR)

( * ) Notice: Subject to any disclaimer, the term of this patent is extended or adjusted under 35 U.S.C. 154(b) by 945 days.

(21) Appl. No.: 11/319,727

(22) Filed: Dec. 29, 2005

(65) Prior Publication Data

US 2006/0187150 A1 Aug. 24, 2006

(30) Foreign Application Priority Data

Feb. 23, 2005 (KR) ..... 10-2005-0015148

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS

| | | | | |
|---|---|---|---|---|
| 6,933,679 | B2 * | 8/2005 | Lee et al. | 315/169.4 |
| 6,961,031 | B2 * | 11/2005 | Lee et al. | 345/60 |
| 7,023,139 | B2 * | 4/2006 | Lee et al. | 315/169.1 |
| 7,027,010 | B2 * | 4/2006 | Lee | 345/60 |
| 7,123,219 | B2 * | 10/2006 | Lee | 345/76 |
| 7,161,564 | B2 * | 1/2007 | Lee et al. | 345/60 |
| 7,176,854 | B2 * | 2/2007 | Lee et al. | 345/60 |
| 7,193,586 | B2 * | 3/2007 | Lee et al. | 345/60 |
| 2003/0071578 | A1 * | 4/2003 | Lee et al. | 315/169.3 |
| 2003/0173905 | A1 * | 9/2003 | Lee et al. | 315/169.3 |
| 2005/0093470 | A1 | 5/2005 | Choi | |

FOREIGN PATENT DOCUMENTS

| | | |
|---|---|---|
| EP | 1 227 464 A2 | 7/2002 |
| EP | 1 316 938 A2 | 6/2003 |
| EP | 1 414 006 A2 | 4/2004 |
| EP | 1 587 051 A2 | 10/2005 |
| JP | 2001-228821 | 8/2001 |
| JP | 2003-005701 | 1/2003 |
| JP | 2003-177700 | 6/2003 |
| JP | 2004-271672 | 9/2004 |
| JP | 2004-310108 | 11/2004 |
| JP | 2004-326116 | 11/2004 |

* cited by examiner

*Primary Examiner*—Ricardo L Osorio
(74) *Attorney, Agent, or Firm*—McKenna Long & Aldridge LLP

(57) ABSTRACT

A plasma display panel employs a voltage circuit having an input and an output, the voltage circuit configured for supplying a negative voltage for an electrode. The plasma display panel also employs a power supply that has a positive terminal and a negative terminal, where the negative terminal is connected to the input of the voltage circuit. The power supply is otherwise configured relative to the voltage circuit such that the voltage difference between the output and the input of the voltage circuit is fixed as a function of the power supply. By fixing this voltage difference, parasitic capacitance is minimized, power consumption and calorific value are reduced, and the plasma display panel operates in a more stable manner.

13 Claims, 10 Drawing Sheets

PLASMA DISPLAY

This application claims the benefit of the Korean Patent Application No. P2005-15148 filed on Feb. 23, 2005, which is hereby incorporated by reference.

BACKGROUND OF THE INVENTION

1. Field of the Invention

The present invention relates to a plasma display panel, and more particularly to a plasma display panel that is adapted for reducing power consumption and calorific value.

2. Description of the Related Art

A plasma display panel (hereinafter 'PDP') excites phosphorus by using ultraviolet ray to emit light, thereby displaying a picture, wherein the ultraviolet ray is generated when an inert gas mixture such as He+Xe, Ne+Xe and He+Xe+Ne is discharged. PDP picture quality has improved due to recent technology development, and they are now thinner and larger than in the past.

In order to realize the gray level of a picture, the PDP is time-dividedly driven by dividing one frame into several sub-fields, each having different light emission values from one another. Each sub field can be further divided into a reset period, to initialize a full screen; an address period, to select scan lines and select discharge cells from the selected scan lines; and a sustain period, to realize gray levels in accordance with the number of discharges. For example, in displaying a picture with 256 gray levels, the frame period (16.67 ms) corresponding to 1/60 second as in FIG. 1 is divided into 8 sub-fields (SF1 to SF8). Each of the 8 sub-fields (SF1 to SF8), as described above, is divided into the reset period, the address period and the sustain period. The reset period and the address period of each sub-field are the same for each sub-field, while the sustain periods differ in that the number of sustain pulses allotted to each increases at the rate of $2^n$ (n=0, 1, 2, 3, 4, 5, 6, 7) for each sub-field SFI-SFB, respectively.

FIG. 2 is a diagram representing an electrode arrangement in accordance with the related art, three electrode AC surface discharge PDP. Referring to FIG. 2, the related art three electrode AC surface discharge PDP includes scan electrodes Y1 to Yn and sustain electrodes Z which are formed in an upper plate, and address electrodes X1 to Xm, which are formed in a lower plate, and cross the scan electrodes Y1 to Yn and the sustain electrodes Z perpendicularly, as shown.

Discharge cells 1 for displaying any one of red, green and blue are arranged in a matrix at the intersections of the scan electrodes Y1 to Yn, the sustain electrode Z and the address electrodes X1 to Xm.

A dielectric layer and an MgO passivation layer (not shown) are deposited on the upper substrate where the scan electrodes Y1 to Yn and the sustain electrodes Z are formed.

Barrier ribs are formed on the lower substrate where the address electrodes X1 to Xm are formed, wherein the barrier ribs prevent optical and electrical crosstalk from occurring between the adjacent discharge cells. A phosphorus layer is formed on the surface of the lower plate and the barrier ribs, wherein the phosphorus is excited by ultraviolet rays to emit visible light.

Between the upper plate and the lower plate there is a discharge space. An inert gas mixture such as He+Xe, Ne+Xe and He+Xe+Ne is injected into the discharge space.

FIG. 3 is a diagram representing a driving waveform supplied to a PDP such as the PDP depicted in FIG. 2. Referring to FIG. 3, each of subfields SFn-1, SFn includes a reset period RP to initialize all of the discharge cells 1 across the entire screen, an address period AP to select certain discharge cells and a sustain period SP to sustain a discharge in those discharge cells 1 that were selected during the address period AP.

In a setup period SU of the reset period RP when $n^{th}$ subfield SFn starts, a positive(+) rising ramp waveform PR is applied to all the scan electrodes Y of the panel Cp, wherein the positive(+) rising ramp waveform PR rises from a sustain voltage Vs to a setup voltage Vsetup, and a ground voltage 0V is applied to the sustain electrodes Z and the address electrodes X. Hereby, in the discharge cells 1 across the entire screen, a dark discharge is generated, in which almost no light is emitted, between the scan electrodes Y and the address electrodes X of the panel Cp, and at the same time, a dark discharge is also generated between the scan electrodes Y and the sustain electrodes Z. As a result, positive(+) wall charges are left on the address electrodes X and the sustain electrodes Z and negative(−) wall charges are left on the scan electrode Y of the panel Cp, at the end of the setup period SU. While the dark discharge is generated in the setup period SU, a gap voltage Vg between the scan electrodes Y and the sustain electrodes Z of the panel Cp and a gap voltage Vg between the scan electrodes Y and the address electrodes X of the panel Cp is established, where the gap voltage Vg is close to a discharge firing voltage Vf, which is necessary to generate the discharge.

In a setdown period SD of the reset period RP subsequent to the setup period SU, a falling ramp waveform NR that falls from the sustain voltage Vs to a negative polarity(−) is applied to the scan electrodes Y of the panel Cp. At the same time, the positive(+) sustain voltage Vs is applied to the sustain electrodes Z and a ground voltage(0V) is applied to the address electrodes X. Hereby, a dark discharge is generated between the scan electrodes Y and the address electrodes X of the panel Cp within all of the discharge cells 1 across the entire screen, and almost at the same time, a dark discharge is generated between the scan electrodes Y and the sustain electrodes Z of the panel Cp. As a result, the wall charge distribution within each discharge cell 1 is changed to a condition which makes addressing possible. At this moment, excessive wall charges unnecessary for the address discharge are eliminated, and positive wall charges of a fixed amount are left on the scan electrodes Y and the address electrodes X of the panel Cp within each of the discharge cells 1. And, the wall charges on the sustain electrodes Z are inverted from the positive(+) polarity to the negative(−) polarity as the negative(−) wall charges moved from the scan electrodes Y of the panel Cp are accumulated. While the dark discharge is generated in the setdown period SD of the reset period RP, the gap voltage between the scan electrodes Y and the sustain electrodes Z of the panel Cp and the gap voltage between the scan electrodes Y and the address electrodes X come close to the discharge firing voltage Vf.

In the address period AP, a negative scan pulse −SCNP is sequentially applied to each of the scan electrodes Y, to Yn of the panel Cp, and for each scan electrode Y, a positive(+) data pulse DP is applied to select address electrodes X in synchronization with the scan pulse −SCNP. The voltage of the scan pulse −SCNP is a voltage that decreases from a negative(−) scan bias voltage Vscb, which is close to a ground voltage (0V), to a negative scan voltage −Vy. The voltage of the data pulse DP is a positive(+) data voltage Va. Further, during the address period AP, a positive(+) Z bias voltage Vzb which is lower than the positive(+) sustain voltage Vs is applied to the sustain electrodes Z. During the address period AP the gap voltage Vg between the scan electrodes Y and the address electrodes X of the panel Cp exceeds the discharge firing voltage Vf only within those cells that were selected (i.e., those cells for which a scan voltage Vsc and a data voltage Va were applied), to generate a first address discharge between the scan electrodes Y and the sustain electrodes Z of the panel Cp. Herein, the first address discharge of the scan electrodes Y and the address electrodes X of the panel Cp is generated at the vicinity of an edge which is far from the gap between the scan electrodes Y and the sustain electrodes Z of the panel Cp. The first address discharge of the scan electrodes Y and the address electrodes X of the panel Cp generates priming charged particles within the discharge cell to induce the scan electrodes Y and the sustain electrodes Z of the panel Cp.

On the other hand, the wall charge distribution within non-selected cells, where the address discharge is not generated, substantially remains at the same state as right after the setdown period SD.

In the sustain period SP, positive(+) sustain pulses SUSP are alternately applied to the scan electrodes Y and the sustain electrodes Z of the panel Cp. Then, the cells selected by the address discharge have a sustain discharge generated between the scan electrodes Y and the sustain electrodes Z of the panel Cp for each sustain pulse SUSP due to the wall charge distribution within the discharge cell which is formed as a result of the address discharge. On the contrary, in the non-selected cells, no discharge is generated during the sustain period. This is because the wall charge distribution in these cells remains at substantially the same state as right after the setdown period SD so that the gap voltage between the scan electrodes Y and the sustain electrodes Z of the panel Cp cannot exceed the discharge firing voltage Vf when the initial positive(+) sustain voltage Vs is applied to the scan electrodes Y. At this moment, the sustain pulses SUSP have the same voltage value as the sustain voltage Vs.

FIG. 4 is a diagram representing certain components in a related art plasma display panel.

Referring to FIG. 4, the related art plasma display panel includes a data driver 42 to supply data to address electrodes X1 to Xm; a scan driver 43 to drive scan electrodes Y1 to Yn; a sustain driver 44 to drive sustain electrodes Z; a timing controller to control each of the drivers 42, 43, 44; and a drive voltage generator 45 to supply the required drive voltages to each of the drivers 42, 43, 44.

The data driver 42 receives data which is mapped to each subfield by a subfield mapping circuit after they are reverse-gamma-corrected and error-diffused by a reverse gamma correction circuit and an error diffusion circuit (not shown). The data driver 42 samples and latches the data in response to a timing control signal from the timing control signal 41, and then it supplies the data voltage Va to the appropriate address electrodes X1 to Xm.

The scan driver 43 supplies initialization waveforms, as in FIG. 3, to the scan electrodes Y1 to Ym during the reset period RP under the control of the timing controller 41, and then supplies the scan bias voltage Vscb to the scan electrodes Y1 to Yn during the address period AP, and sequentially supplies the scan pulse −SCNP to the scan electrodes Y1 to Yn. And, the scan driver 43 supplies the sustain pulse SUSP to the scan electrodes Y1 to Ym during the sustain period under the control of the timing controller 41.

The sustain driver 44 supplies the positive(+) sustain voltage Vs and the positive(+) Z bias voltage Vzb to the sustain electrodes Z during the setdown period SD and the address period AP under the control of the timing controller 41, and then supplies the sustain pulse SUSP to the sustain electrodes Z by alternately operating the scan driver 43 during the sustain period.

The timing controller 41 receives a vertical/horizontal synchronization signal and a clock signal to generate timing control signals Cx, Cy, Cz required for each driver. It then supplies the timing control signals Cx, Cy, Cz to the corresponding drivers 42, 43, 44, thereby controlling the signals generated by each of the drivers 42, 43, 44. The data control signal Cx includes a sampling clock to sample the data, a latch control signal and a switch control signal to control the on/off time of a drive switch device and an energy recovery circuit within the data driver 42. The scan signal Cy includes a switch control signal to control the on/off time of a drive switch device and an energy recovery circuit within the scan driver 43. And the sustain control signal Cz includes a switch control signal to control the on/off time of a drive switch device and an energy recovery circuit within the sustain driver 44.

The drive voltage generator 45 generates a setup voltage Vsetup, a negative(−) scan voltage Vy, a DC bias voltage Vscb, Vzb, a positive(+) sustain voltage Vs and a data voltage Va.

FIG. 5 is a circuit diagram representing the scan driver 43 and the sustain driver 44 in detail. Referring to FIG. 5, the scan driver 43 includes a first energy recovery circuit 51, first to ninth switches SW1 to SW9 and a drive switch circuit 55. The sustain driver 44 includes a second energy recovery circuit 52 and twelfth and thirteenth switches SW12 and SW13.

The first and second energy recovery circuits 51 and 52 recover the reactive power energy, which does not contribute to the discharge in the PDP 40, from the scan electrode Y and the sustain electrode Z of the panel Cp and charges the scan electrode Y and the sustain electrode Z of the panel Cp using the recovered energy.

The drive switch circuit 55 includes tenth and eleventh switches SW10 and SW11 which are connected in a push-pull configuration between a third node N3 and a fourth node N4. An output terminal between the tenth and eleventh switch devices SW10, SW11 is connected to the scan electrode Y of the panel Cp.

The tenth switch SW10 is connected between the fourth node N4 and the scan electrode Y of the panel Cp to supply the voltage at node N4 to the scan electrode Y of the panel Cp through its body diode.

The eleventh switch SW11 is connected between the third node N3 and the scan electrode Y of the panel Cp to supply the voltage on the third node N3 to the scan electrode Y of the panel Cp through its body diode.

The first switch SW1 is connected between the sustain voltage source Vs and the first node N1 to supply the sustain voltage Vs to the first node N1 in accordance with a first switching control signal.

The second switch SW2 is connected between the ground voltage source GND and the first node N1 to supply the ground voltage GND to the first node N1 in accordance with a second switching control signal.

The third switch SW3 is connected between the first node N1 and the second node N2 to electrically connect the first node N1 with the second node N2 in accordance with a third switching control signal.

The fourth switch SW4 is connected between the setup voltage source Vsetup and the second node N2, and has its gate terminal connected to a first variable resistor R1. The fourth switch SW4 supplies a voltage, which rises to the setup voltage Vsetup with a designated slope in accordance with the change of the resistance value of the first variable resistor R1, to the second node N2 when a fourth switching control signal is supplied.

The fifth switch SW5 is connected between the second node N2 and the third node N3 to electrically connect the second node N2 with the third node N3 in accordance with a fifth switching control signal.

The sixth switch SW6 is connected between the third node N3 and the scan voltage source Vy, and has its gate terminal connected to a second variable resistor R2. The sixth switch SW6 supplies a voltage, which drops to the negative(−) scan voltage Vy with a designated slope in accordance with the change of the resistance value of the second variable resistor R2, to the third node N3 when a sixth switching control signal is supplied.

The seventh switch SW7 is connected between the third node N3 and the scan voltage source Vy to supply the negative (−) scan voltage Vy to the third node N3 in accordance with a fifth switching control signal.

The eighth switch SW8 is connected between the third node N3 and the fourth node N4 to electrically connect the third node N3 with the fourth node N4 in accordance with an eighth switching control signal.

The ninth switch SW9 is connected between the scan bias voltage source Vscb and the fourth node N4 to supply the scan bias voltage Vscb to the fourth node N4 in accordance with a ninth switching control signal.

The twelfth and thirteenth switches SW12 and SW13 are connected in series between the sustain voltage source Vs and the ground voltage source GND to supply the sustain voltage and the ground voltage to the sustain electrodes Z for the sustain period.

The switches SW1 to SW 13 are realized using field effect transistors (FET) which include embedded body diodes.

However, the related art scan driver 43, as shown in FIG. 6, induces a voltage at a gate terminal G, as shown in FIG. 7, as a current is charged/discharged through a parasitic capacitor between the drain terminal D and the gate terminal G of the sixth and seventh switches SW6, SW7 connected between the scan voltage source Vy and the third node N3, when the sustain pulse is applied to the scan electrode Y of the panel Cp because the negative(−) scan voltage source Vy is connected to the real ground, i.e., the ground voltage source GND. At this moment, if the voltage induced at the gate terminal G is higher than the threshold voltage of the FET associated with switch SW6, the sixth switch SW6 is abnormally turned on. This is a malfunction and, in the worst case, the sixth switch SW6 is destroyed. Further, the voltage induced at the gate terminal G not only increases the calorific temperature of the plasma display panel due to the parasitic capacitor C and the second parasitic resistor R2 connected to the gate terminal G, but it also increases power consumption.

SUMMARY OF THE INVENTION

Accordingly, it is an object of the present invention to provide a plasma display panel that is adapted to reduce power consumption and calorific value.

In accordance with a first aspect of the present invention, the above-identified and other objects are achieved by a plasma display panel. The plasma display panel comprises, among other things, a first voltage supplier to supply a sustain voltage and a ground voltage to a scan electrode through a first node, a second voltage supplier to supply a setup voltage to the scan electrode through a second node which is separated from the first node, a third voltage supplier to supply a negative voltage to the scan electrode through a third node which is separated from the first and second nodes, and a fourth voltage supplier to supply a scan bias voltage to the scan electrode through a fourth node which is separated from the first to third nodes. In addition, the plasma display panel comprises a power supply connected between the second node and the third voltage supplier.

In accordance with another aspect of the present invention, the above-identified and other objects are achieved by a plasma display panel. The plasma display panel comprises, among other things, a first voltage supplier to supply a sustain voltage and a ground voltage to a scan electrode through a first node, a second voltage supplier to supply a setup voltage to the scan electrode through a second node which is separated from the first node, a third voltage supplier to supply a negative voltage to the scan electrode through a third node which is separated from the first and second nodes, and a fourth voltage supplier to supply a scan bias voltage to the scan electrode through a fourth node which is separated from the first to third nodes. In addition, the plasma display panel further comprises a power supply connected between the first node and the third voltage supplier.

In accordance with still another aspect of the present invention, the above-identified and other objects are achieved by a plasma display panel. The plasma display panel comprises, among other things, a first voltage supplier to supply a sustain voltage and a ground voltage to an electrode, a second voltage supplier to supply a setup voltage to the electrode, a third voltage supplier to supply a negative voltage to the electrode, and a fourth voltage supplier to supply a scan bias voltage to the electrode. The plasma display panel also comprises a switch drive circuit to supply a voltage from the first to fourth voltage suppliers to the electrode, as well as a power supply having a positive terminal and a negative terminal. The positive terminal is connected to any one of an output node associated with the first voltage supplier and an output node associated with the second voltage supplier. The negative terminal is connected to a power input terminal associated with the third voltage supplier.

In accordance with yet another aspect of the present invention, the above-identified and other objects are achieved by a plasma display panel scan driver which supplies voltage for a scan electrode in accordance with a driving waveform. The scan driver comprises a first voltage circuit having an input and an output, the circuit configured for supplying a negative voltage for the scan electrode. The scan driver also comprises a power supply comprising a positive terminal and a negative terminal. The negative terminal is connected to the input of the first voltage circuit, and the power supply is otherwise configured relative to the first voltage circuit such that the voltage difference between the output and the input of the first voltage circuit is fixed as a function of the power supply.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE ILLUSTRATED EMBODIMENTS

Reference will now be made in detail to the preferred embodiments of the present invention, examples of which are illustrated in the accompanying drawings.

Hereinafter, the preferred embodiments of the present invention will be described in detail with reference to FIGS. 8 to 10.

Figure 8:
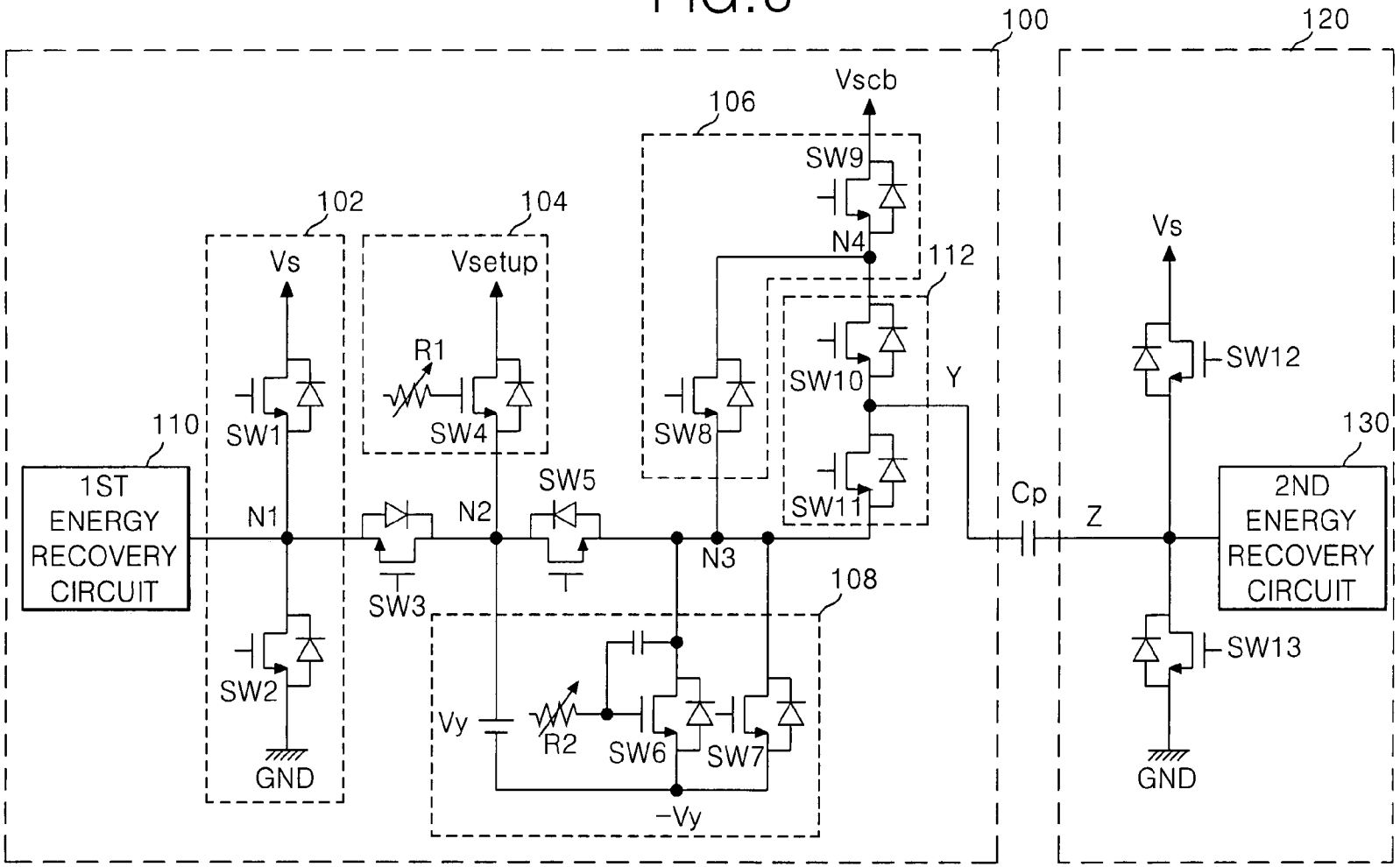
FIG. 8 is a circuit diagram representing a scan driver for plasma display panel according to an embodiment of the present invention.

FIG. 8 is a diagram representing a plasma display panel according to an embodiment of the present invention. Referring to FIG. 8, the plasma display panel according to the present invention includes a scan driver 100 and a sustain driver 130.

Figure 1:
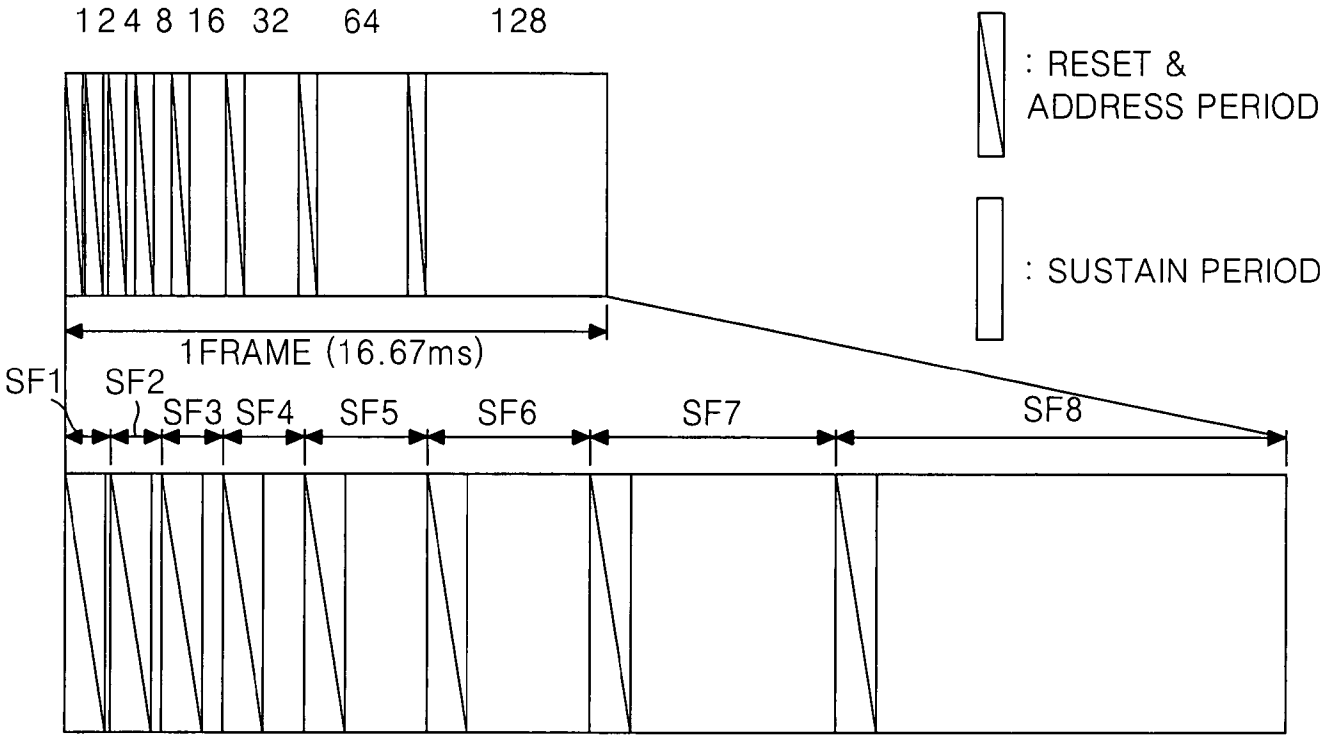
FIG. 1 RELATED ART
FIG. 1 is a diagram representing a subfield pattern of an 8 bit default code in order to realize 256 gray levels in a PDP.
Figure 2:
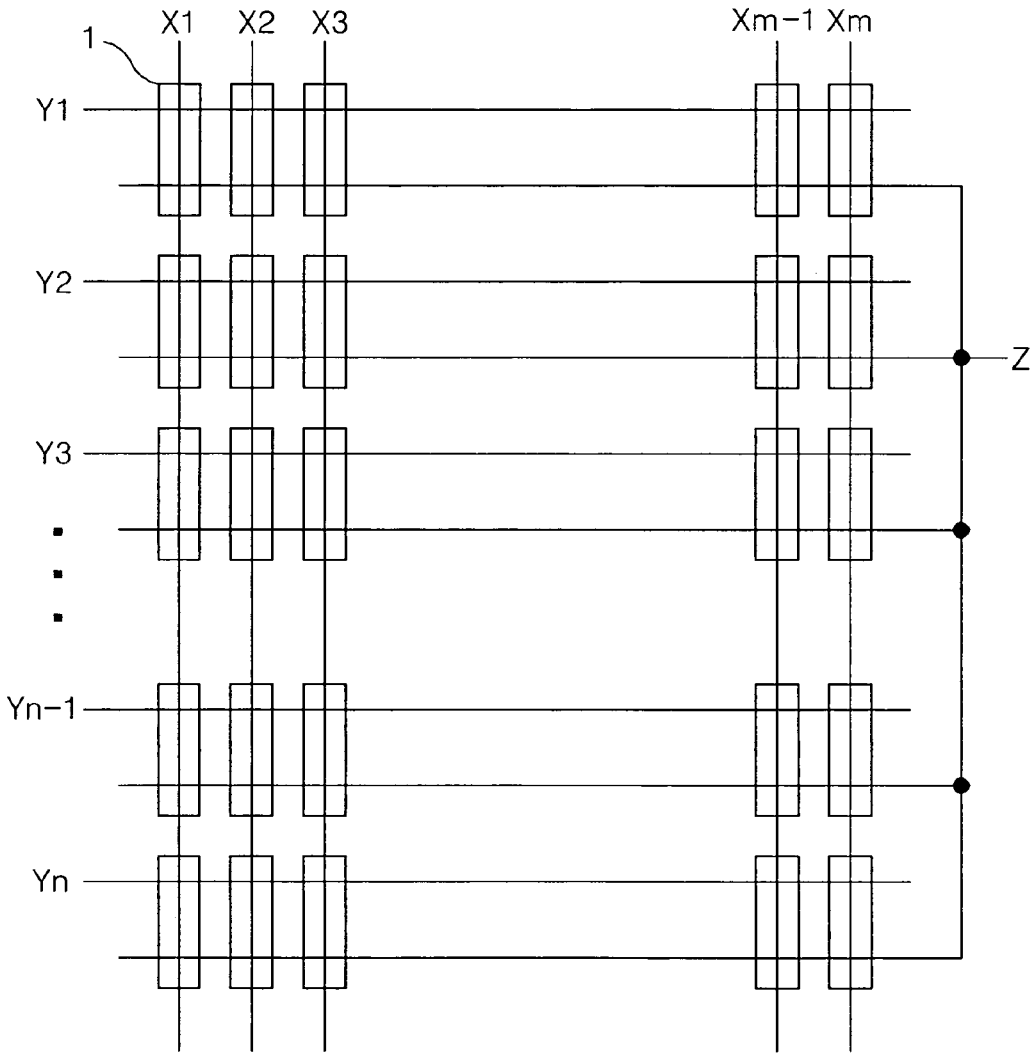
FIG. 2 RELATED ART
FIG. 2 is a diagram that represents an electrode arrangement for a three electrode AC surface discharge PDP, in accordance with the related art.
Figure 3:
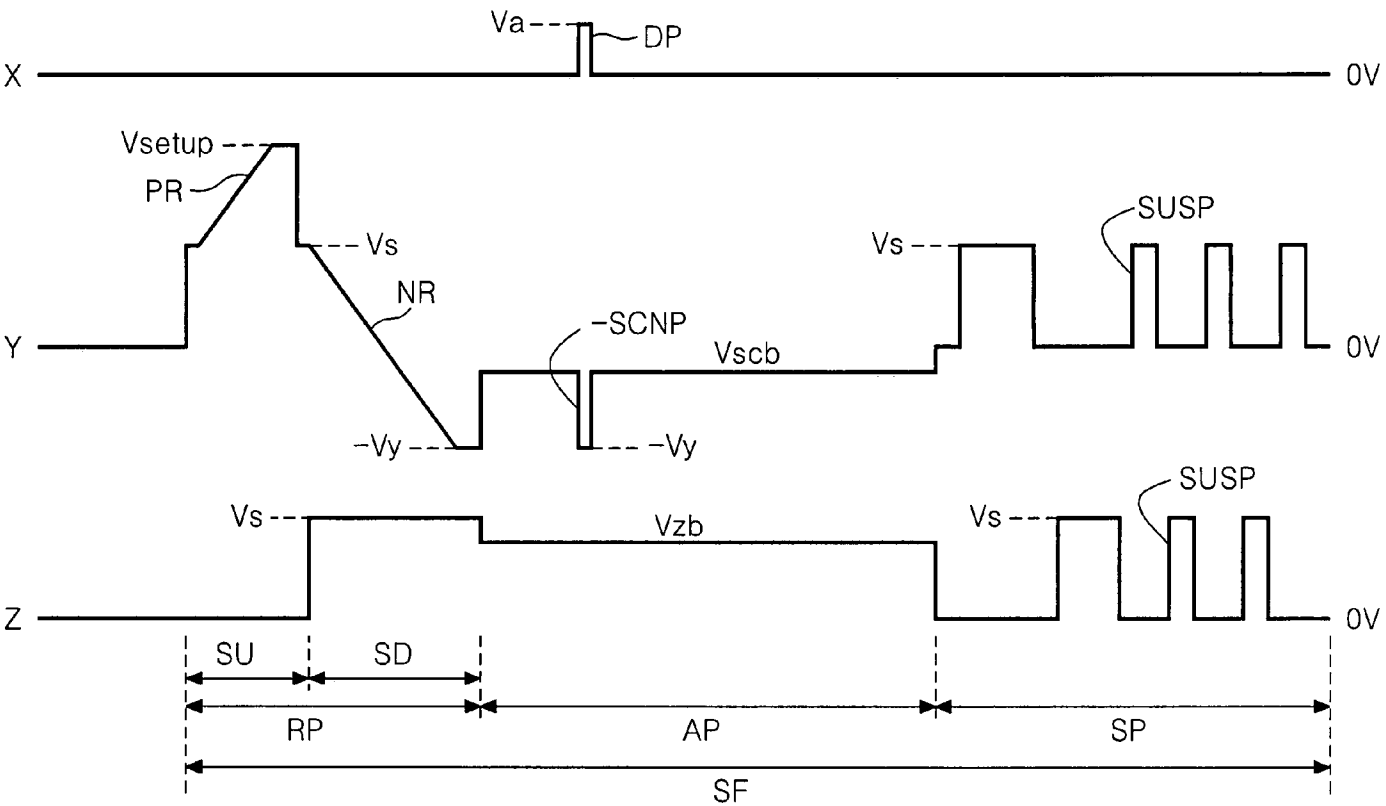
FIG. 3 RELATED ART
FIG. 3 is a diagram representing a drive waveform for the related art PDP.
Figure 4:
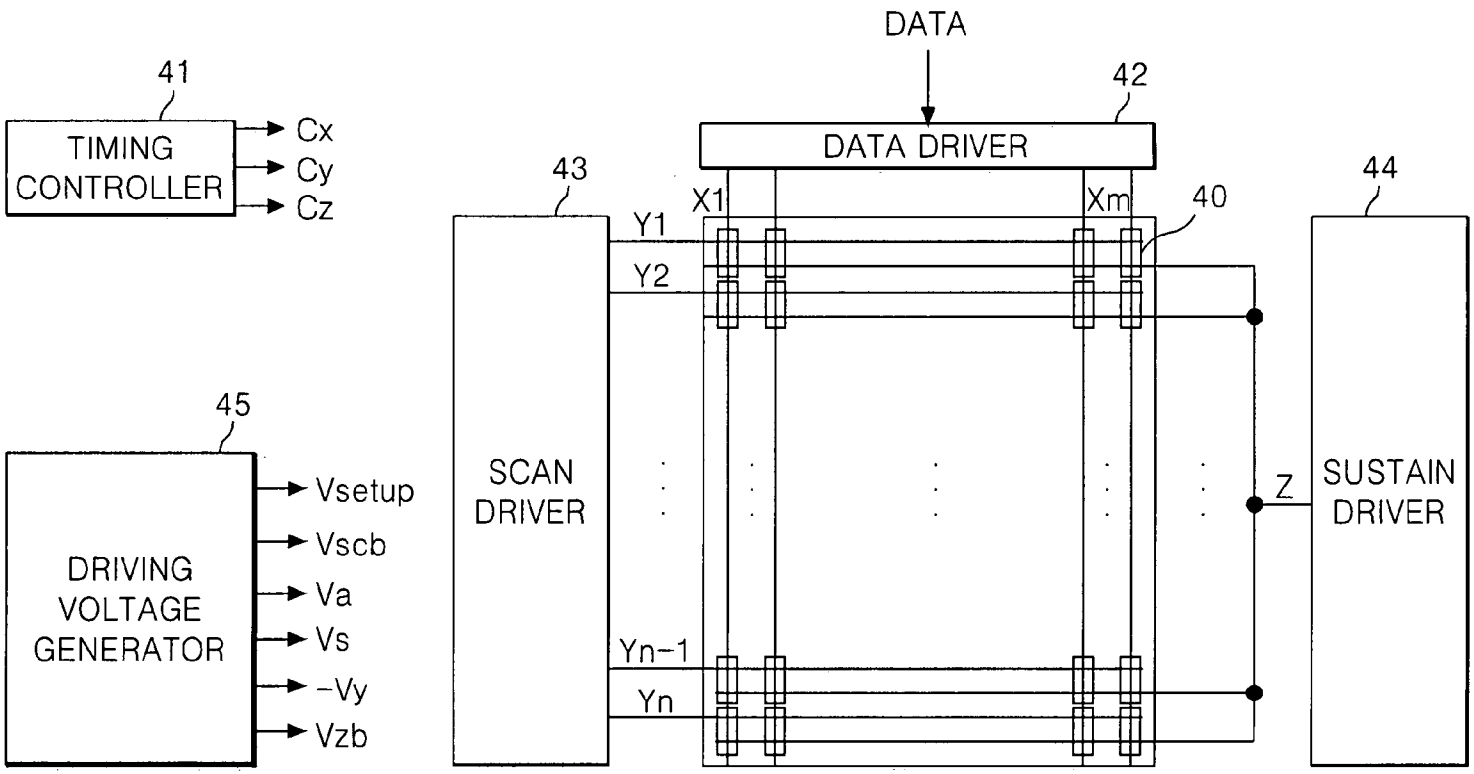
FIG. 4 RELATED ART
FIG. 4 is a diagram representing various components in the related art PDP.

The scan driver 100 supplies initialization waveforms as shown, for example, in FIG. 3, to the scan electrodes Y of a panel Cp during the reset period RP under control of a timing controller (not shown), and then the scan bias voltage Vscb to the scan electrodes Y of the panel Cp and then the scan pulse −SCNP to each of the scan electrodes Y of the panel Cp sequentially during the address period AP. Further, the scan driver 100 supplies the sustain pulse SUSP having a sustain voltage level Vs to the scan electrodes Y of the panel Cp during the sustain period SP under the control of the timing controller. The scan driver 100 includes an energy recovery circuit 110, a first sustain voltage supplier 102, a setup voltage supplier 104, a scan voltage supplier 108, a scan bias voltage supplier 106, a switch drive circuit 112 and third and fifth switches SW3 and SW5.

The first energy recovery circuit 110 recovers the reactive power energy, which does not contribute to the discharge of the PDP, from the scan electrode Y of the panel Cp and charges the scan electrode Y of the panel Cp using the recovered energy.

The first sustain voltage supplier 102 supplies the sustain voltage Vs to the scan electrodes Y of the panel Cp for a portion of the reset period RP in accordance with the control signal supplied from the timing controller. It also supplies the sustain pulse voltage level Vs to the scan electrodes Y of the panel Cp during the sustain period SP. To achieve this, the first sustain voltage supplier 102 includes first and second switches SW1 and SW2 connected in series between the sustain voltage source Vs and the ground voltage source GND, as shown in FIG. 8. A first node N1 between the first switch SW1 and the second switch SW2 is connected to the energy recovery circuit 110.

The first switch SW1 electrically connects the sustain voltage source Vs with the first node N1 to supply the sustain voltage Vs to the first node N1 in accordance with a first switching control signal supplied from the timing controller.

The second switch SW2 electrically connects the ground voltage source GND with the first node N1 to supply the ground voltage GND to the first node N1 in accordance with a second switching control signal supplied by the timing controller.

The setup voltage supplier 104 supplies the setup voltage Vsetup to the scan electrodes Y of the panel Cp during the setup period SU of the reset period RP in accordance with the corresponding control signal supplied by the timing controller. The setup voltage supplier 104 includes a fourth switch SW4 connected between the setup voltage source and a second node N2.

The fourth switch SW4 is connected between the setup voltage source and the second node N2 and has its gate terminal connected to a first variable resistor R1. The fourth switch SW4 supplies a voltage, which rises to the setup voltage Vsetup with a designated slope in accordance with the change of the resistance value of the first variable resistor R1, to the second node N2 when a fourth switching control signal is supplied by the timing controller.

The scan voltage supplier 108 is connected between the setup voltage supplier 104, the scan bias voltage supplier 106 and the switch drive circuit 112. It supplies the negative(−) scan voltage −Vy to the scan electrodes Y of the panel Cp during the address period AP in accordance with the corresponding control signal supplied by the timing controller. To achieve this, the scan voltage supplier 108 includes sixth and seventh switches SW6 and SW7, connected in parallel between the second node N2 and the third node N3, and a scan voltage source Vy of which the positive(+) terminal is connected to the second node N2 and the negative(−) terminal is connected to the sixth and seventh switches SW6 and SW7.

The sixth switch SW6 is connected between the third node N3, at one side of the scan bias voltage supplier 106, the negative(−) terminal of the scan voltage source Vy and the seventh switch SW7. Moreover, its gate terminal is connected to a second variable resistor R2. The sixth switch SW6 supplies a voltage, which drops to the negative(−) scan voltage −Vy at a designated slope in accordance with the change of the resistance value of the second variable resistor R2, to the third node N3 when a sixth switching control signal is supplied by the timing controller. The sixth switch SW6 is simultaneously turned on with the second switch SW2, the third switch SW3 and the eighth switch SW8 to form a current path from the second switch SW2 to the fourth node N4 through the third switch SW3, the scan voltage source Vy and the eighth switch SW8. Consequently, the voltage at the fourth node N4 drops to the negative(−) scan voltage −Vy at a designated slope. At the same time, the scan electrode Y of the panel Cp is connected to the fourth node N4 through the body diode of the tenth switch SW10, thus the voltage at the fourth node N4, which drops from the sustain voltage level Vs to the negative(−) scan voltage −Vy at the designated slope, is supplied to the scan electrode Y of the panel Cp during the set-down period of the reset period RD.

The seventh switch SW7 is connected between the switch drive circuit 112, the third node N3, the sixth switch SW6 and the negative(−) terminal of the scan voltage source Vy to supply the negative(−) scan voltage 'Vy to the third node N3 in accordance with a seventh switching control signal supplied by the timing controller. The seventh switch SW7 is simultaneously turned on with the second switch SW2 and the third switch SW3 to form a current path from the second switch SW2 to the third node N3 through the third switch SW3, the scan voltage source Vy and the seventh switch SW7. Accordingly, the negative(−) scan voltage −Vy is supplied to the third node N3. At the same time, the scan electrode Y of the panel Cp is connected to the third node N3 through the body diode of the eleventh switch SW11, thus the negative(−) scan voltage −Vy is supplied to the scan electrode Y of the panel Cp.

The scan bias voltage supplier 106 is connected between the third node N3 and the switch drive circuit 112 to supply the positive(+) scan bias voltage Vscb to the scan electrodes Y during the address period AP in accordance with a corresponding control signal supplied by the timing controller. To achieve this, the scan bias voltage supplier 106 includes a ninth switch SW9 connected between the scan bias voltage source Vscb and the fourth node N4, and an eighth switch SW8 connected between the third node N3 and the fourth node N4.

The eighth switch SW8 electrically connects the third node N3 with the fourth node N4 in accordance with an eighth switching control signal supplied by the timing controller. The ninth switch SW9 supplies the scan bias voltage Vscb to the fourth node N4 in accordance with a ninth switching control signal supplied by the timing controller.

The switch drive circuit 112 includes tenth and eleventh switches SW10 and SW11 which are connected in a push-pull configuration between the third node N3 and the fourth node N4. The switch drive circuit 112 also includes an output terminal between the tenth and eleventh switches SW10, SW11, which is connected to the scan electrode Y of the panel Cp.

The tenth switch SW10 is connected between the fourth node N4 and the scan electrode of the panel Cp to supply through its body diode the voltage at the fourth node N4 to the scan electrode Y of the panel Cp.

The eleventh switch SW11 is connected between the third node N3 and the scan electrode Y of the panel Cp to supply the voltage on the third node N3 to the scan electrode Y of the panel Cp through its body diode.

The third switch SW3 is connected between the first node N1 and the second node N2 to electrically connect the first node N1 with the second node N2 in accordance with a third switching control signal supplied by the timing controller.

The fifth switch SW5 is connected between the second node N2 and the third node N3 to electrically connect the second node N2 with the third node N3 in accordance with a fifth switching control signal supplied by the timing controller.

The sustain driver 120 supplies the sustain pulses having the sustain voltage level Vs to the sustain electrode Z during the sustain period SP. The sustain driver 120 includes the second energy recovery circuit 130 and the twelfth and thirteenth switches SW12, SW13.

The second energy recovery circuit 130 recovers the reactive power energy, which does not contribute to the discharge of the PDP, from the sustain electrode Z and charges the sustain electrode Z using the recovered energy.

The twelfth switch SW12 supplies the sustain voltage Vs to the sustain electrode Z in accordance with a twelfth switching control signal supplied by the timing controller. The thirteenth switch SW13 supplies the ground voltage GND to the sustain electrode Z in accordance with a thirteenth switching control signal supplied by the timing controller.

Figure 9:
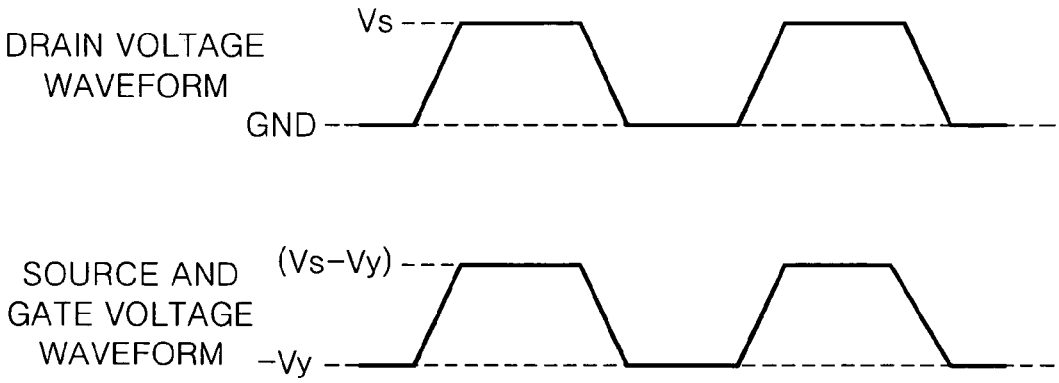
FIG. 9 is a diagram representing the voltage that is induced at switches, of a scan voltage source shown in FIG. 8 during a sustain period.

The plasma display panel according to an exemplary embodiment of the present invention connects the scan voltage supplier 108 between the setup voltage supplier 104, the scan bias voltage supplier 106 and the switch drive circuit 112, as shown in FIG. 9. The waveform supplied to the drain terminal of the sixth and seventh switches SW6, SW7 of the scan voltage suppler 108 and the waveform supplied to the source and gate terminals increases or decreases in the same manner when the sustain voltage Vs is supplied to the scan electrodes Y of the panel Cp during the sustain period SP, thus preventing voltage from being induced between the gate terminal and the source terminal.

Figure 6:
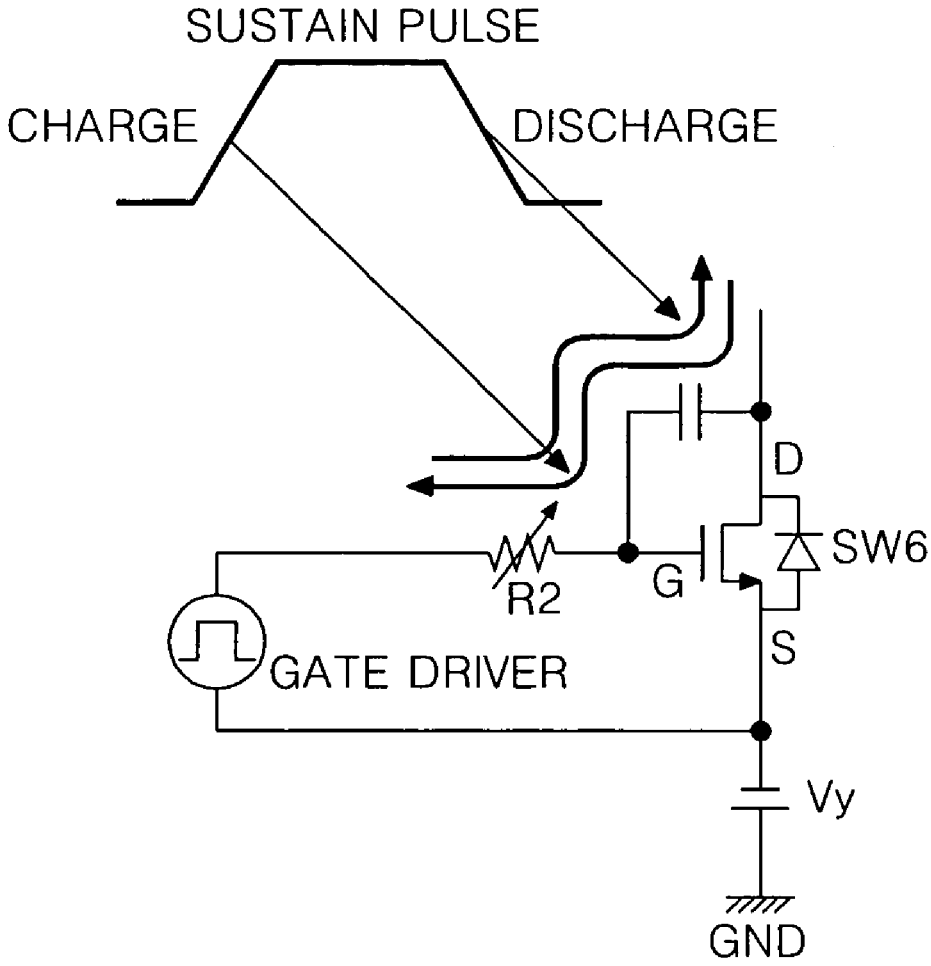
FIG. 6 RELATED ART
FIG. 6 is a diagram representing current flow in the scan voltage source shown in FIG. 5 when a sustain pulse is charged/discharged in a scan electrode during a sustain period, in accordance with the related art.
Figure 7:
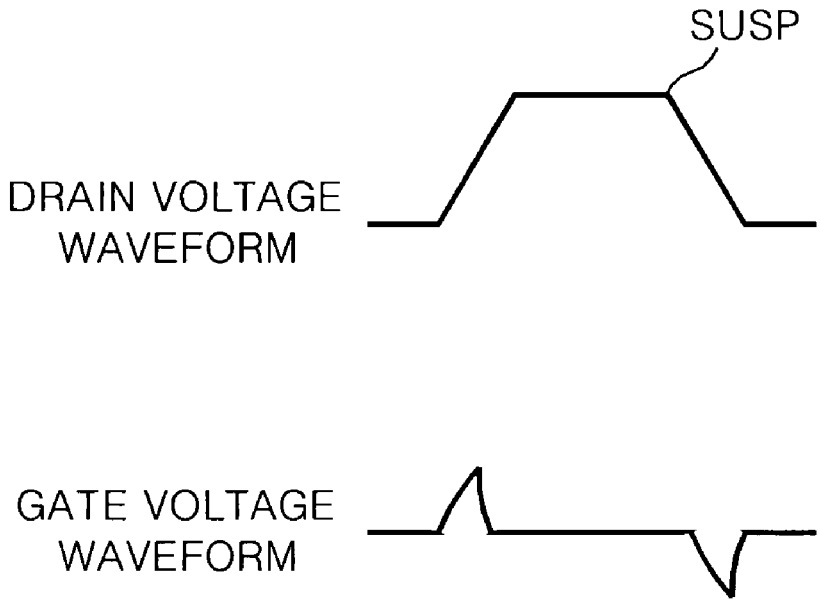
FIG. 7 RELATED ART
FIG. 7 is a diagram representing the voltage induced at a gate terminal of the scan voltage source shown in FIG. 5 during the sustain period, in accordance with the related art.

More specifically, according to this exemplary embodiment of the present invention, the reference voltage of a power supply, e.g., a DC-DC converter, which supplies the negative(−) scan voltage −Vy in the scan voltage supplier 108, is applied to the output terminal of the setup voltage supplier 104, as shown in FIG. 8. Herein, the power supply fixedly sustains the voltage difference between the positive terminal connected to the second node N2 and the negative terminal connected to a voltage supply terminal of the scan voltage supplier 108 (i.e., the source terminals of the sixth and seventh switches SW6 and SW7). For instance, if the voltage difference between the positive terminal and the negative terminal of the power supply is 200V, the negative terminal is −200V when the voltage on the second node N2 is 0V, the negative terminal rises to −100V when the voltage on the second node N2 is changed to 100V and the negative terminal rises to 0V when the voltage on the second node N2 is changed to 200V. Since the drain, the source and the gate of the sixth switch SW6 are each connected to the positive(+) terminal or the negative(−) terminal of the power supply, across which is a fixed voltage, the voltage across the drain and gate terminals, the voltage across the gate and source terminals, and the voltage across the source and drain terminals remain fixed (i.e., consistent). Accordingly, there is no voltage change across the parasitic capacitor illustrated in FIG. 6, thus no charging/discharging current flows in the parasitic capacitor. That is because the current in the parasitic capacitor is defined by the following equation: $i=C*dv/dt$ where dv is the change in voltage across the parasitic capacitor. Thus, when $dv=0$, the current $i=0$ also.

Accordingly, the plasma display panel according to this exemplary embodiment of the present invention can reduce power consumption as well as reducing calorific value. Further, the change in voltage difference between the gate terminal and the source terminal of the switches SW6 and SW7 remains at 0V in the scan voltage supplier 108 during the sustain period, thereby enabling the plasma display panel to be driven in a stable manner.

Figure 10:
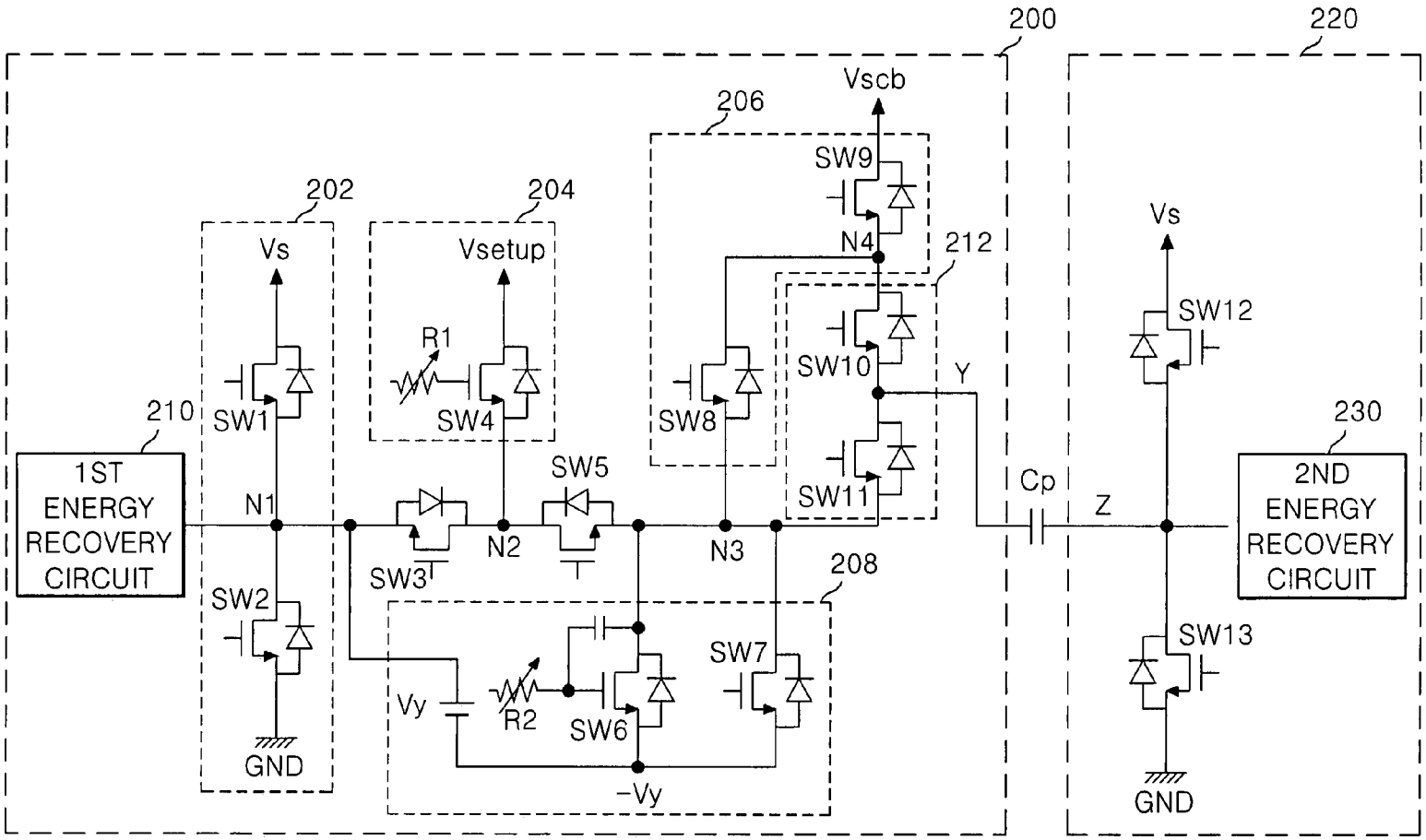
FIG. 10 is a circuit diagram representing a scan driver for a plasma display panel according to another embodiment of the present invention.

FIG. 10 is a diagram representing a plasma display panel according to another exemplary embodiment of the present invention. Referring to FIG. 10, the plasma display panel according to another embodiment of the present invention includes a scan driver 200 and a sustain driver 220.

The scan driver 200 supplies initialization waveforms, as shown in FIG. 3, to scan electrodes Y of a panel Cp during the reset period RP under the control of a timing controller (not shown). The scan driver 200 then supplies a scan bias voltage Vscb to the scan electrodes Y of the panel Cp and, thereafter, a scan pulse −SCNP to the scan electrodes Y of the panel Cp during the address period AP. Further, the scan driver 200 supplies a sustain pulse SUSP having a sustain voltage level Vs to the scan electrodes Y of the panel Cp during the sustain period SP under the control of the timing controller. The scan driver 200 includes an energy recovery circuit 210, a sustain voltage supplier 202, a setup voltage supplier 204, a scan voltage supplier 208, a scan bias voltage supplier 206, a switch drive circuit 212 and third and fifth switches SW3 and SW5.

The plasma display panel according to this exemplary embodiment of the present invention is similar to the previous embodiment but for the connection of the scan voltage supplier 208. Thus the detailed description of this exemplary embodiment other than the connection of the scan voltage supplier 208 will be omitted.

The scan voltage supplier 208 is connected between the sustain voltage supplier 202, the scan bias voltage supplier 206 and the switch drive circuit 212 to supply the negative(−) scan voltage −Vy to the scan electrodes Y of the panel Cp during an address period AP in accordance with a corresponding control signal supplied by the timing controller. To achieve this, the scan voltage supplier 208 includes sixth and seventh switches SW6 and SW7 and the scan voltage source Vy connected in parallel. The scan voltage source Vy has the positive(+) terminal connected between the first node N1 and the third switch SW3 and the negative(−) terminal connected to the source terminal of the sixth and seventh switches SW6 and SW7.

The sixth switch SW6 is connected between the third node N3, at one side of the scan bias voltage supplier 206, the negative(−) terminal of the scan voltage source Vy and the seventh switch SW7. Additionally, the gate terminal of switch SW6 is connected to a second variable resistor R2. The sixth switch SW6 supplies a voltage, which drops to the negative (−) scan voltage −Vy at a designated slope in accordance with the change of the resistance value of the second variable resistor R2, to the third node N3 when a sixth switching control signal is supplied by the timing controller. The sixth switch SW6 is simultaneously turned on with the second switch SW2 and the eighth switch SW8 to form a current path from the second switch SW2 to the fourth node N4 through the scan voltage source Vy and the eighth switch SW8. Consequently, the voltage, which drops to the negative(−) scan voltage −Vy at the designated slope, is supplied to the fourth node N4. At the same time, the scan electrode Y of the panel Cp is connected to the fourth node N4 through the body diode of the tenth switch SW10, thus the voltage, which drops from the sustain voltage level Vs to the negative(−) scan voltage −Vy at the designated slope, is supplied to the scan electrode Y of the panel Cp.

The seventh switch SW7 is connected between the third node N3, the sixth switch SW6 and the negative(−) terminal of the scan voltage source Vy to supply the negative(−) scan voltage −Vy to the third node N3 in accordance with a seventh switching control signal supplied by the timing controller. The seventh switch SW7 is simultaneously turned on with the second switch SW2 to form a current path from the second switch SW2 to the third node N3 through the scan voltage source Vy and the seventh switch SW7. Hereby, the negative (−) scan voltage −Vy is supplied to the third node N3. At the same time, the scan electrode Y of the panel Cp is connected to the third node N3 through the body diode of the eleventh switch SW11, thus the negative(−) scan voltage −Vy is supplied to the scan electrode Y of the panel Cp.

The plasma display panel according to this alternative exemplary embodiment of the present invention connects the scan voltage supplier 208 between the sustain voltage supplier 202, the scan bias voltage supplier 206 and the switch drive circuit 212 and, as shown in FIG. 9, the waveform supplied to the drain terminal of the sixth and seventh switches SW6, SW7 of the scan voltage suppler 208 and the waveform supplied to the source and gate terminals increase or decrease simultaneously and to the same extent when the sustain voltage Vs is supplied to the scan electrodes Y of the panel Cp during the sustain period SP. This prevents a voltage from being induced between the gate terminal and the source terminal. Accordingly, the plasma display panel according to this embodiment of the present invention also reduces power consumption and calorific value. Further, the change in voltage difference between the gate terminal and the source terminal of the switches SW6 and SW7 remains at 0V in the scan voltage supplier 208 during the sustain period, thereby enabling the plasma display panel to be driven in a stable manner.

More specifically, according to this alternative exemplary embodiment of the present invention, the reference voltage of a power supply, e.g., a DC-DC converter, which supplies the negative(−) scan voltage −Vy in the scan voltage supplier 208, is connected to the output terminal of the sustain voltage source 202, as shown in FIG. 10, from ground GND. Accordingly, the drain, the source and the gate of the sixth switch SW6 are each connected to the positive(+) terminal or the negative(−) terminal of the power supply, across which is a fixed voltage at all times. Thus there is no change in the voltage difference between the drain, the source and the gate terminals. Accordingly, there is no voltage change across the parasitic capacitor described in FIG. 6, thus no charging/discharging current through the parasitic capacitor per the relationship i=C*dV/dt.

Figure 5:
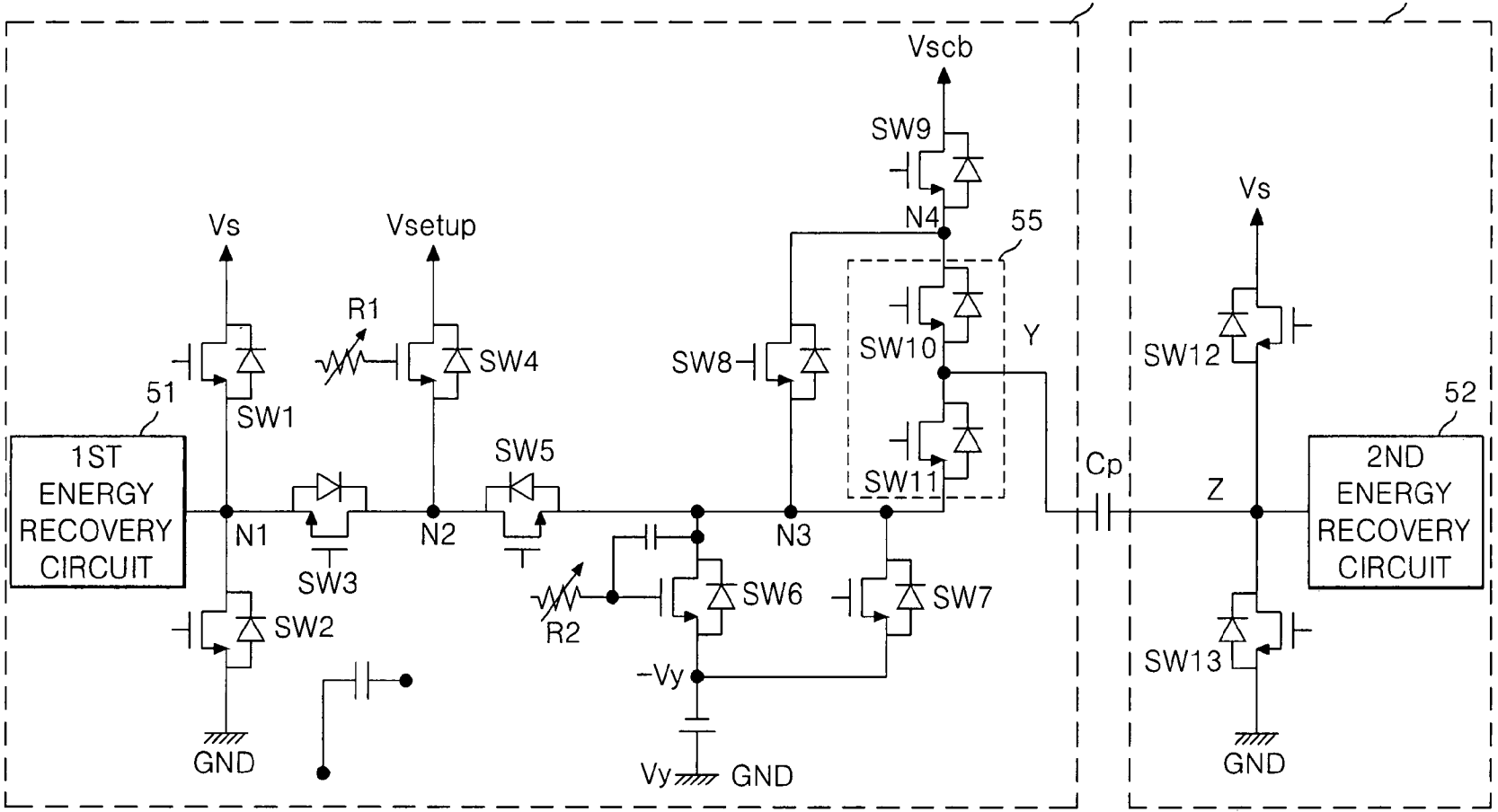
FIG. 5 RELATED ART
FIG. 5 is a circuit diagram representing a related art scan driver and a related art sustain driver as shown in FIG. 4.

As described above, the plasma display panel according to the present invention does not connect the positive terminal of the scan voltage source directly to the ground voltage source as in the related art device illustrated in FIG. 5. Thus, the waveform supplied to the drain terminal of the switches which constitute the scan voltage suppler and the waveform supplied to the source and gate terminals increase or decrease simultaneously and to the extent so as to prevent voltage from being induced between the gate terminal and the source terminal. Accordingly, the plasma display panel according to the present invention reduces power consumption as well as calorific value.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel comprising:

a first voltage supplier to supply a sustain voltage and a ground voltage to a scan electrode through a first node;

a second voltage supplier to supply a setup voltage to the scan electrode through a second node which is separated from the first node;

a third voltage supplier to supply a negative voltage to the scan electrode through a third node which is separated from the first and second nodes;

a fourth voltage supplier to supply a scan bias voltage to the scan electrode through a fourth node which is separated from the first to third nodes; and a power supply connected between the second node and the third voltage supplier.

2. The plasma display panel according to claim 1, wherein a positive terminal of the power supply is connected to the second node and a negative terminal of the power supply is connected to a power input node of the scan bias voltage supplier, and wherein the third voltage supplier comprises:

sixth and seventh switches connected in parallel between the negative terminal of the power supply and the third node.

3. The plasma display panel according to claim 2, wherein the third voltage supplier further includes:

a variable resistor and a capacitor connected to the sixth switch device to control the gradient of a setdown waveform supplied to the scan electrode.

4. The plasma display panel according to claim 1 further comprising:

a third switch connected between the first node and the second node; and a fifth switch connected between the second node and the third node.

5. The plasma display panel according to claim 4, wherein the fourth voltage supplier includes:

an eighth switch connected between the third node and the fourth node; and a ninth switch device connected between the fourth node and a scan bias voltage source which generates a scan bias voltage.

6. A plasma display panel comprising:

a first voltage supplier to supply a sustain voltage and a ground voltage to a scan electrode through a first node;

a second voltage supplier to supply a setup voltage to the scan electrode through a second node which is separated from the first node;

a third voltage supplier to supply a negative voltage to the scan electrode through a third node which is separated from the first and second nodes;

a fourth voltage supplier to supply a scan bias voltage to the scan electrode through a fourth node which is separated from the first to third nodes; and a power supply connected between the first node and the third voltage supplier.

7. The plasma display panel according to claim 6, wherein a positive terminal of the power supply is connected to the first node and a negative terminal of the power supply is connected to a power input node of the scan bias voltage supplier, and wherein the third voltage supplier includes:

sixth and seventh switches connected in parallel between the negative terminal of the power supply and the third node.

8. The plasma display panel according to claim 7, wherein the third voltage supplier further includes:

a variable resistor and a capacitor connected to the sixth switch device to control the gradient of a setdown waveform supplied to the scan electrode.

9. The plasma display panel according to claim 6, further comprising:

a third switch connected between the first node and the second node; and a fourth switch connected between the second node and the third node.

10. The plasma display panel according to claim 6, further comprising:

a switch drive circuit to supply a voltage from the fourth node and the third node to the scan electrode.

11. A plasma display panel comprising:

a first voltage supplier to supply a sustain voltage and a ground voltage to an electrode;

a second voltage supplier to supply a setup voltage to the electrode;

a third voltage supplier to supply a negative voltage to the electrode;

a fourth voltage supplier to supply a scan bias voltage to the electrode;

a switch drive circuit to supply a voltage from the first to fourth voltage suppliers to the electrode; and a power supply having a positive terminal and a negative terminal, wherein the positive terminal is connected to any one of an output node associated with the first voltage supplier and an output node associated with the second voltage supplier, and wherein the negative terminal is connected to a power input terminal associated with the third voltage supplier.

12. The plasma display panel according to claim 11, wherein the third voltage supplier includes:

sixth and seventh switches connected in parallel between the negative terminal of the power supply and a third node which is positioned between the third voltage supplier, the fourth voltage supplier and the switch drive circuit.

13. The plasma display panel according to claim 12 wherein the third voltage supplier further includes:

a variable resistor and a capacitor connected to the sixth switch to control the gradient of a setdown waveform supplied to the scan electrode.

* * * * *